US006680084B1

(12) United States Patent
Chtourou

(10) Patent No.: US 6,680,084 B1
(45) Date of Patent: Jan. 20, 2004

(54) FORMATION OF ORIENTED MULTILAYER POLYMERIC FILMS

(75) Inventor: Halim Chtourou, Granby (CA)

(73) Assignee: Simex Technologies Inc., Saint-Laurent (CA)

( * ) Notice: Subject to any disclaimer, the term of this patent is extended or adjusted under 35 U.S.C. 154(b) by 745 days.

(21) Appl. No.: 09/592,549

(22) Filed: Jun. 12, 2000

(30) Foreign Application Priority Data

Jun. 10, 1999 (CA) ..... 2274384

(51) Int. Cl.[7] ..... B05D 3/12

(52) U.S. Cl. ..... 427/359; 427/264; 427/265; 427/361; 427/411

(58) Field of Search ..... 427/264, 265, 427/359, 361, 286, 411; 118/118

(56) References Cited

U.S. PATENT DOCUMENTS

| | | | | |
|---|---|---|---|---|
| 215,321 A | | 5/1879 | Cavin | |
| 1,575,868 A | | 3/1926 | Roles | |
| 2,066,780 A | | 1/1937 | Holt | 91/18 |
| 2,975,074 A | | 3/1961 | Jankens et al. | 117/76 |
| 3,231,411 A | | 1/1966 | Tyler et al. | 117/76 |
| 3,690,910 A | | 9/1972 | Mahe et al. | 117/7 |
| 4,267,215 A | | 5/1981 | Riggs | 427/372.2 |
| 4,869,933 A | * | 9/1989 | Sollinger et al. | 427/356 |
| 5,077,109 A | | 12/1991 | Lustig et al. | 428/36.91 |
| 5,340,611 A | | 8/1994 | Kurstermann et al. | 427/361 |
| 5,482,770 A | | 1/1996 | Bekele | 428/339 |
| 5,595,601 A | * | 1/1997 | Lintula | 118/110 |
| 5,759,648 A | | 6/1998 | Idlas | 428/34.9 |

FOREIGN PATENT DOCUMENTS

| | | |
|---|---|---|
| DE | 3 710 059 | 10/1988 |
| WO | WO 98/20202 | 5/1998 |

* cited by examiner

*Primary Examiner*—Katherine A. Bareford
(74) *Attorney, Agent, or Firm*—Ogilvy Renault

(57) ABSTRACT

The invention relates to a substrate coated with an oriented multilayer polymeric film comprising at least two layers of polymer particles oriented along two different directions with respect to one another. Such an oriented multilayer polymeric film has improved flexibility as well as improved gas barrier properties. A method of forming the film on a substrate is also disclosed.

54 Claims, 6 Drawing Sheets

FORMATION OF ORIENTED MULTILAYER POLYMERIC FILMS

BACKGROUND OF THE INVENTION

The present invention pertains to improvements in the field of oriented multilayer polymeric films. More particularly, the invention relates to a substrate coated with an oriented multilayer polymeric film having improved flexibility and improved gas barrier properties, as well as to a method of forming such a film on a substrate.

When considering gas barrier properties of an extruded polymeric film coated on a substrate, it is already known in the art that the diffusion coefficient of any penetrating gas such as oxygen, carbon dioxide or water vapor through the polymer film decreases by increasing the crystallinity of the film. This can be achieved by a chemical approach (molecular design) and appropriate cooling rate (chilling in the coating process).

In the case of a substrate coated with an oriented multilayer polymeric film formed from a water-based polymer dispersion and wherein the polymer particles of each layer are oriented in the same direction, it is also known that a three-layer film provides a stronger barrier to gas than a two-layer film having the same weight, which in turn is much more efficient than a one-layer film also having the same weight. Water-based polymer dispersions comprise very small polymer particles having an average size ranging from 150 to 200 mm and containing macro-molecules. When coated on a substrate and properly dried to remove the water, a continuous film is formed.

Whereas scientists are still studying and modeling oriented multilayer polymeric films formed from water-based polymer dispersions, they all agree that these films have a weak flexibility compared to that of extruded polymeric films. This weak flexibility renders waterborne barrier coatings in the packaging industry less attractive. The film flexibility is weak mainly when the film is folded about a fold line parallel to the direction of orientation of the polymer particles in each layer of the multilayer film, causing the film to break at the fold line. This of course impairs the gas barrier properties of the film.

SUMMARY OF THE INVENTION

It is therefore an object of the present invention to overcome the above drawbacks and to provide a substrate coated with an oriented multilayer polymeric film which is formed from a polymer dispersion and which has improved flexibility as well as improved gas barrier properties.

It is another object of the invention to provide a method of forming the above film on a substrate.

According to one aspect of the present invention, there is thus provided a substrate coated with an oriented multilayer polymeric film, wherein the film comprises at least two layers of polymer particles oriented along two different directions with respect to one another.

Applicant has found quite unexpectedly that the presence of at least two layers of polymer particles oriented along two different directions with respect to one another in a multilayer polymeric film improves the flexibility of such a film as well as the gas barrier properties thereof.

The present invention also provides, in another aspect thereof, a method of forming the above oriented multilayer polymeric film on a substrate. The method according to the invention comprises the steps of:

a) conveying a substrate along a predetermined path at a predetermined travelling speed and in a predetermined travelling direction;

b) coating the substrate with a polymer dispersion containing polymer particles and a liquid dispersing medium to form on the substrate a first coating of the dispersion;

c) contacting the first coating with a first particle orienting roller driven for rotation about a first longitudinal axis thereof independently of the substrate so as to have a first tangential speed at a surface of the coated substrate, the first particle orienting roller having a first particle orienting pattern arranged at a first angle relative to the travelling direction of the substrate to cause orientation of the polymer particles of the first coating along a first predetermined direction;

d) drying the first coating to cause evaporation of the liquid dispersing medium and formation of a first layer of oriented polymer particles on the substrate; and e) successively forming on the first layer at least one further layer of oriented polymer particles, each further layer being formed by:

i) coating a previously formed underlying layer of oriented polymer particles with the polymer dispersion to form on the underlying layer a further coating of the dispersion;

ii) contacting the further coating with a further particle orienting roller driven for rotation about a further longitudinal axis thereof independently of the substrate so as to have a further tangential speed at the surface of the coated substrate, the further particle orienting roller having a further particle orienting pattern arranged at a further angle relative to the travelling direction of the substrate to cause orientation of the polymer particles of the further coating along a further predetermined direction; and iii) drying the further coating to cause evaporation of the liquid dispersing medium and formation of the further layer of oriented polymer particles on the underlying layer;

wherein at least one further angle is different from the first angle or at least one further tangential speed is different from the first tangential speed, thereby forming on the substrate an oriented multilayer polymeric film having at least two layers of polymer particles oriented along two different directions with respect to one another.

The polymer particles are preferably particles of a waterborne polymer. Examples of suitable waterborne polymers which may be used include polyvinylidene chloride, polyvinyl acetate, polyvinyl alcohol and styrene-butadiene copolymers. The liquid dispersing medium can comprise, for example, water, an alcohol or a mixture thereof.

According to a preferred embodiment of the invention, the first particle orienting roller comprises a first cylindrical member rotatable about the aforesaid first longitudinal axis and a first continuous helical land on the first cylindrical member over at least a portion of the length thereof, the first helical land forming a first continuous helical particle orienting groove along the first cylindrical member. The first land and the first groove define the aforesaid first particle orienting pattern. The first helical land may be defined by a single wire helically and tightly wound about a major portion of the length of the first cylindrical member.

According to another preferred embodiment of the invention, two further layers of oriented polymer particles are formed in step (e) by:

i) coating the first layer of oriented polymer particles with the polymer dispersion to form on the first layer a second coating of the dispersion;

ii) contacting the second coating with a second particle orienting roller driven for rotation about a second longitudinal axis thereof independently of the substrate so as to have a second tangential speed at the surface of the coated substrate, the second particle orienting roller having a second particle orienting pattern arranged at a second angle relative to the travelling direction of the substrate to cause orientation of the polymer particles of the second coating along a second predetermined direction;

iii) drying the second coating to cause evaporation of the liquid dispersing medium and formation of a second layer of oriented polymer particles on the first layer;

iv) coating the second layer of oriented polymer particles with the polymer dispersion to form on the second layer a third coating of the dispersion;

v) contacting the third coating with a third particle orienting roller driven for rotation about a third longitudinal axis thereof independently of the substrate so as to have a third tangential speed at the surface of the coated substrate, the third particle orienting roller having a third particle orienting pattern arranged at a third angle relative to the travelling direction of the substrate to cause orientation of the polymer particles of the third coating along a third predetermined direction; and vi) drying the third coating to cause evaporation of the liquid dispersing medium and formation of a third layer of oriented polymer particles on the second layer.

The second angle is different from the aforementioned first angle or the second tangential speed is different from the aforementioned first tangential speed, whereby the second predetermined direction is different from the aforementioned first predetermined direction. The third angle is different from the second angle or the third tangential speed is different from the second tangential speed, whereby the third predetermined direction is different from the second predetermined direction.

Preferably, the second particle orienting roller comprises a second cylindrical member rotatable about the aforesaid second longitudinal axis and a first plurality of juxtaposed continuous helical lands on the second cylindrical member over at least a portion of the length thereof, the helical lands of the first plurality having a similar pitch and forming a first series of helical particle orienting grooves along the second cylindrical member, the lands of the first plurality and the grooves of the first series defining the second particle orienting pattern. The third particle orienting roller, on the other hand, comprises a third cylindrical member rotatable about the aforesaid third longitudinal axis and a second plurality of juxtaposed continuous helical lands on the third cylindrical member over at least a portion of the length thereof, the helical lands of the second plurality having a similar pitch and forming a second series of helical particle orienting grooves along the third cylindrical member, the lands of the second plurality and the grooves of the second series defining the third particle orienting pattern.

The aforementioned particle orienting roller provided with a series of helical particle orienting grooves is novel and constitutes a further aspect of the invention.

The present invention therefore provides, in a further aspect thereof, a particle orienting roller for orienting polymer particles present in a polymer dispersion coated on a substrate. The particle orienting roller according to the invention comprises a cylindrical member rotatable about a longitudinal axis thereof and a plurality of juxtaposed continuous helical lands on the cylindrical member over at least a portion of the length thereof. The helical lands have a similar pitch and form a series of helical particle orienting grooves along the cylindrical member for imparting a predetermined orientation to the polymer particles when the cylindrical member is rotated while being in contact with the polymer dispersion.

According to a preferred embodiment, the helical lands are defined by a plurality of juxtaposed wires helically wound about the cylindrical member, the helical particle orienting grooves being each defined between adjacent wires.

According to another preferred embodiment, the helical lands are defined by a plurality of helical ribs integrally formed on a peripheral surface of the cylindrical member, the helical particle orienting grooves being each defined between adjacent ribs.

According to a further preferred embodiment, the helical particle orienting grooves are integrally defined in a peripheral surface of the cylindrical member.

A particularly preferred oriented multilayer polymeric film formed on a substrate in accordance with the invention is an oriented three-layer polymeric film having a first layer comprising polymer particles oriented along a first direction, a second layer disposed on the first layer and comprising polymer particles oriented along a second direction angled at about 45° relative to the first direction, and a third layer disposed on the second layer and comprising polymer particles oriented along a third direction parallel to the first direction.

As previously noted, the oriented multilayer polymeric film formed on a substrate in accordance with the present invention has improved flexibility and improved gas barrier properties.

BRIEF DESCRIPTION OF THE DRAWINGS

Further features and advantages of the invention will become more readily apparent from the following description of preferred embodiments as illustrated by way of examples in the accompanying drawings, in which.

DESCRIPTION OF PREFERRED EMBODIMENTS

Figure 1:
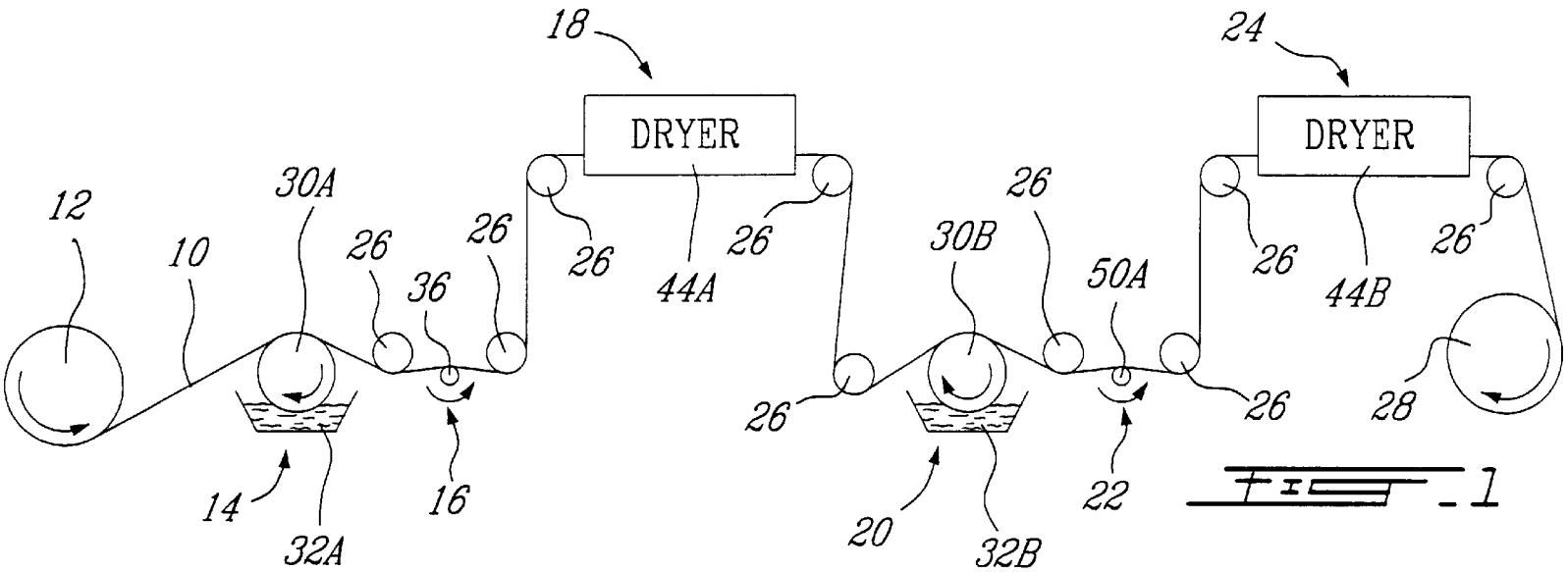
FIG. 1 is a schematic view of an apparatus for carrying out a method of forming an oriented two-layer polymeric film on a substrate, according to a preferred embodiment of the invention.
Figure 2:
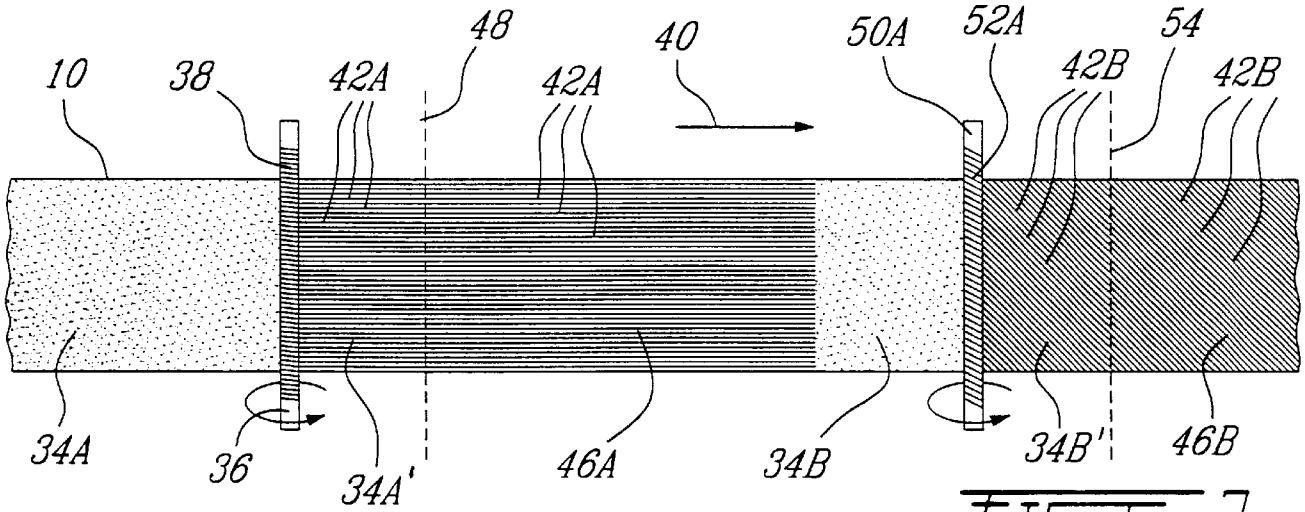
FIG. 2 is a partial schematic bottom plan view of the apparatus shown in FIG. 1, illustrating the orientation of the polymer particles in the successive coatings applied onto the substrate.

Referring first to FIGS. 1 and 2, a continuous web 10 of paper is conveyed from a paper roll 12 through a first coating station 14, a first particle orienting station 16, a first drying station 18, a second coating station 20, a second particle orienting station 22 and a second drying station 24, by guide rollers 26 and a take-up driving roller 28. At the coating station 14, a first coating roller 30A partially immersed in a first bath 32A of polymer dispersion containing polymer particles and water is used for coating the paper web 10 with the polymer dispersion so as to form on the paper web 10 a first coating 34A of polymer dispersion. At the particle orienting station 16, the first coating 34A is contacted with a first particle orienting roller 36 which is driven for counterclockwise rotation about its longitudinal axis independently of the paper web 10 so as to have a tangential speed at the surface of the coated paper web 10. The particle orienting roller 36 is driven by a suitable drive mechanism (not shown). It has a particle orienting pattern 38 arranged at an angle relative to the travelling direction 40 of the paper web 10 to cause orientation of the polymer particles of the first coating 34A along a first predetermined direction. In the embodiment illustrated, the polymer particles 42A of the first coating 34A' downstream of the roller 36 are oriented in a direction parallel to the travelling direction 40 of the paper web 10; in other words, they are oriented at an angle of 0°. The paper web 10 provided with the coating 34A' of oriented polymer particles 42A is then passed through a first dryer 44A to cause evaporation of the water present in the coating 34A' and formation of a first layer 46A of oriented polymer particles 42A on the paper web 10. In FIG. 2, the broken line 48 represents the start of the first drying step.

At the second coating station 20, a second coating roller 30B partially immersed in a second bath 32B of the polymer dispersion is used for coating the first layer 46A with the polymer dispersion so as to form on the layer 46A a second coating 34B of polymer dispersion. At the second particle orienting station 22, the second coating 34B is contacted with a second particle orienting roller 50A which is driven for counterclockwise rotation about its longitudinal axis independently of the paper web 10 so as to have a tangential speed at the surface of the coated paper web 10. The particle orienting roller 50A is driven by a suitable drive mechanism (not shown). The tangential speed of the particle orienting roller 50A is the same as the tangential speed of the particle orienting roller 36. The roller 50A has a particle orienting pattern 52A arranged at angle relative to the travelling direction 40 of the paper web 10 to cause orientation of the of the polymer particles of the second coating 34B along a second predetermined direction. In the embodiment illustrated, the polymer particles 42B of the second coating 34B' downstream of the roller 50A are oriented in a direction angled at about 45° relative to the travelling direction 40 of the paper web 10. The paper web 10 provided with the layer 46A of oriented polymer particles 42A, on which is disposed the coating 34B' of oriented polymer particle 42B' of oriented polymer particles 42B, is then passed through a second dryer 44B to cause evaporation of the water present in the coating 34B' and formation of a second layer 46B of oriented polymer particles 42B on the first layer 46A of oriented polymer particles 42A. In FIG. 2, the broken line 54 represents the start of the second drying step.

Thus, the apparatus shown in FIG. 1 enables one to form on the paper web 10 an oriented two-layer polymeric film having a first layer 46A comprising polymer particles 42A oriented along a predetermined direction (i.e. 0°), and a second layer 46B disposed on the first layer 46A and comprising polymer particles 42B oriented along a direction angled at about 45° relative to the direction of orientation of the polymer particles 42A.

Figure 3:
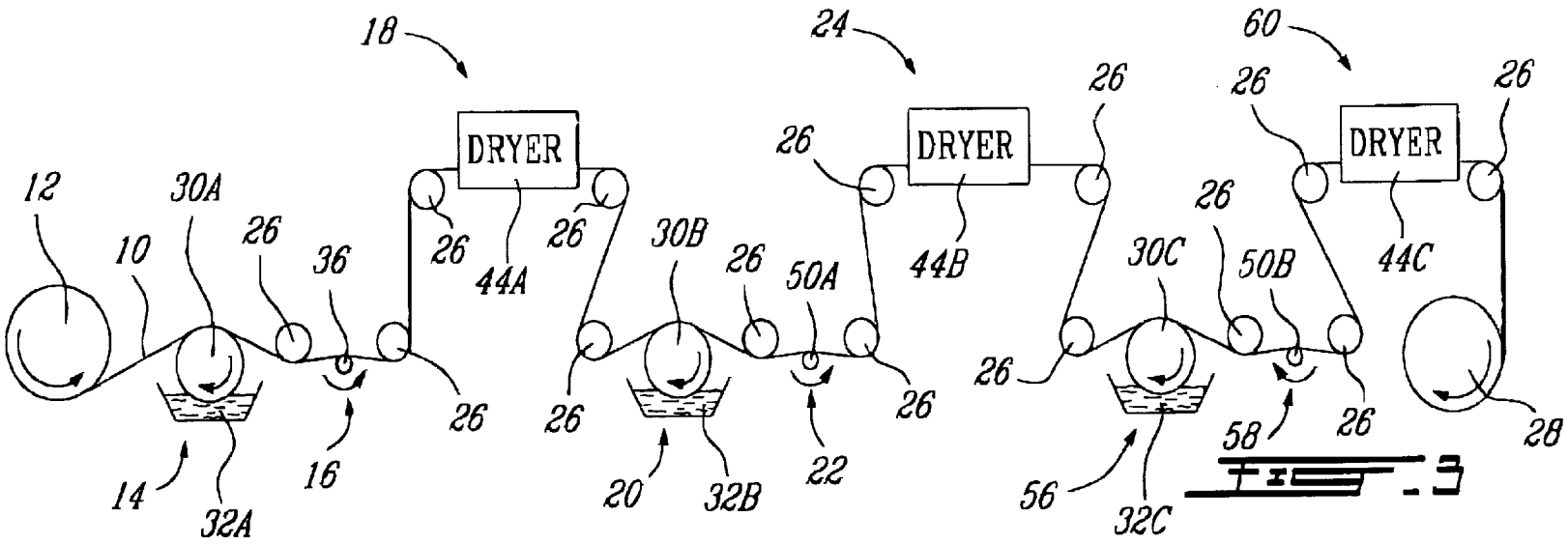
FIG. 3 is a schematic view of an apparatus for carrying out a method of forming an oriented three-layer polymer film on a substrate, according to another preferred embodiment of the invention.
Figure 4:
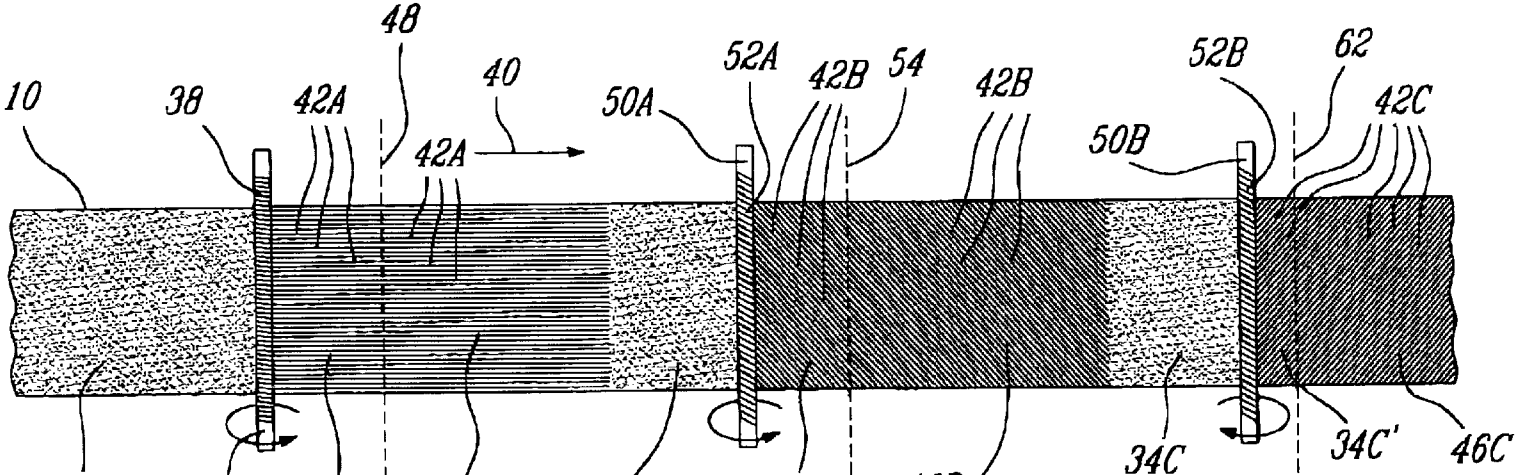
FIG. 4 is a partial schematic bottom plan view of the apparatus shown in FIG. 3, illustrating the orientation of the polymer particles in the successive coatings applied onto the substrate.

The apparatus illustrated in FIG. 3 is similar to the one illustrated in FIG. 1, with the exception that a third coating station 56, a third particle orienting station 58 and a third drying station 60 have been added in order to form on the second layer 46B of oriented polymer particles 42B a third layer of oriented polymer particles, As shown in FIGS. 3 and 4, at the coating station 56, a third coating roller 30C partially immersed in a third bath 32C of the polymer dispersion is used for coating the second layer 46B with the polymer dispersion so as to form on the layer 46B a third coating 34C of polymer dispersion. At the particle orienting station 58, the third coating 34C is contacted with a third particle orienting roller 50B which is driven for clockwise rotation about its longitudinal axis independently of the paper web 10 so as to have a tangential speed at the surface of the coated paper web 10. The particle orienting roller 50B is driven by a suitable drive mechanism (not shown). It has a particle orienting pattern 52B which is the same as the particle orienting pattern 52A of the particle orienting roller 50A. Since the roller 50B has a negative tangential speed as opposed to the positive tangential speed of the roller 50A, the particle orienting pattern 52B of the roller 50B imparts to the polymer particles of the third coating 34C an orientation along a direction which is the mirror image of the direction of orientation of the polymer particles 42B of the second layer 46B Thus, in the embodiment illustrated, the polymer particles 42C of the third coating 34C' downstream of the roller 50B are oriented in a direction angled at about 45° relative to the travelling direction 40 of the paper web 10, but at 90° relative to the direction of orientation of the polymer particles 42B of the second layer 46B. The paper web 10 provided with the layer 46A of oriented polymer particles 42A and the layer 46B of oriented polymer particles 42B, on which is disposed the coating 34C' of oriented polymer particles 42C, is then passed through a third dryer 44C to cause evaporation of the water present in the coating 34C' and formation of a third layer 46C of oriented polymer particles 42C on the second layer 46B of oriented polymer particles 42B. In FIG. 4, the broken line 62 represents the start of the third drying step.

It is of course possible to replace the particle orienting roller 50B by the particle orienting roller 36 driven for counterclockwise rotation about its longitudinal axis. In this case, the direction of orientation of the polymer particles 42C of the third layer 46C would be the same as the direction of orientation of the polymer particles 42A of the first layer 46A. In other words, the polymer particles 42C of the third layer 46C would be oriented in a direction parallel to the travelling direction 40 of the paper web 10 (i.e. at 0°).

Figure 5:
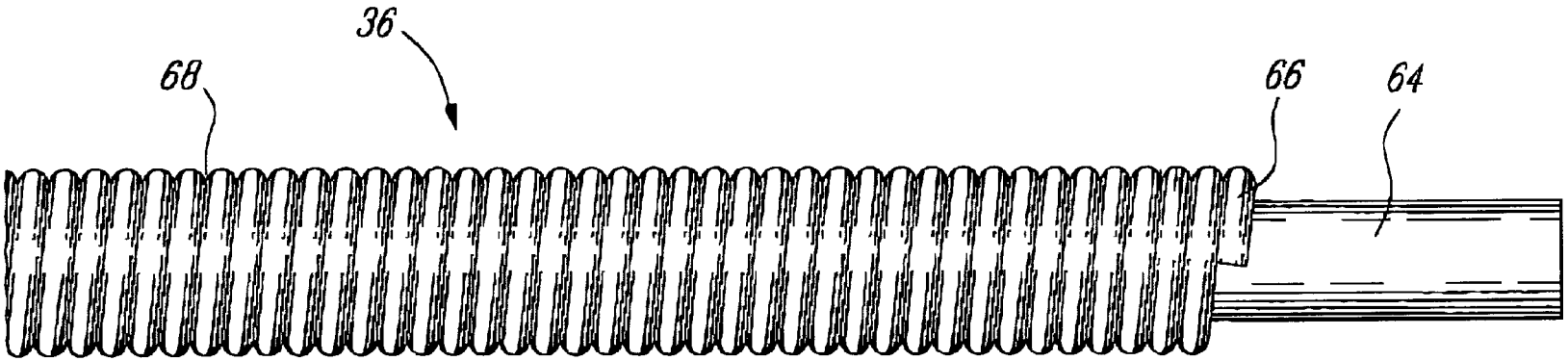
FIG. 5 (PRIOR ART)
FIG. 5 is a partial side view of a conventional particle orienting roller which is used in the apparatuses shown in FIGS. 1 and 3.

The particle orienting roller 36 used in the apparatuses shown in FIGS. 1 and 3 is a conventional particle orienting roller which is illustrated in more detail in FIG. 5. As shown in FIG. 5, the roller 36 comprises a cylindrical member 64 and a single wire 66 helically and tightly wound about the cylindrical member 64 over a major portion of the length thereof. The single wire 66 forms a continuous helical groove 68 adapted to impart to the polymer particles an orientation in a direction at 90° relative to the longitudinal axis of the cylindrical member 64. The single wire 66 defines a continuous helical land or ridge on the circumference of the cylindrical member 64. Thus, the pitch of the particle orienting roller 36 is equal to a lead thereof, the lead being the distance a helical land or ridge advances axially in one turn of the particle orienting roller 36. The land defined by the single wire 66 together with the groove 68 define the aforesaid particle orienting pattern 38.

Figure 6:
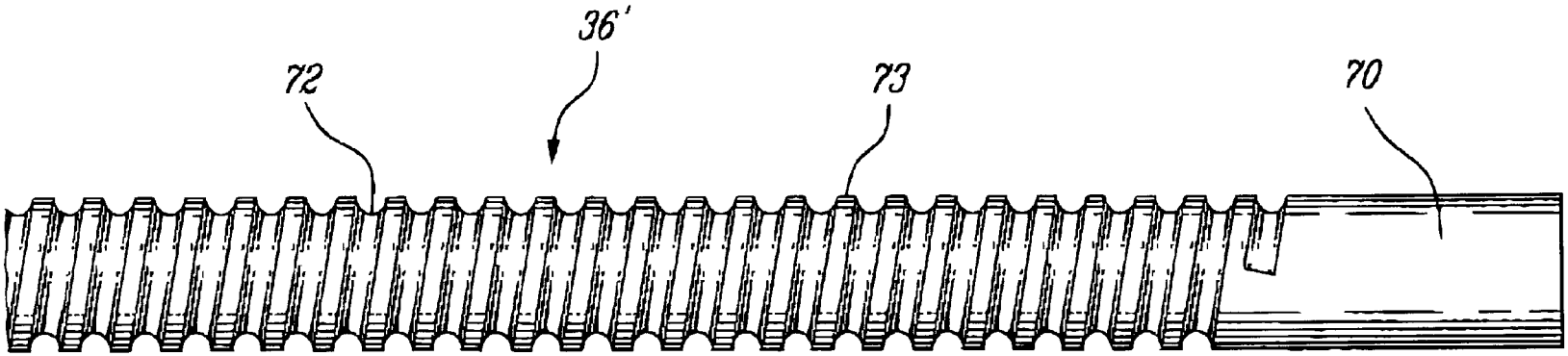
FIG. 6 (PRIOR ART)
FIG. 6 is a partial side view of another conventional particle orienting roller which may also be used in the apparatus shown in FIG. 1 or 3.

Instead of using the particle orienting roller 36, it is possible to use the roller 36' illustrated in FIG. 6. As shown, the particle orienting roller 36' comprises a cylindrical member 70 provided with a single helical groove 72 which is integrally defined in the peripheral surface of the cylindrical member 70 and extends along a major portion of the length thereof. The helical groove 72 is adapted to impart to the polymer particles an orientation in a direction at 90° relative to the longitudinal axis of the cylindrical member 70. In this single helical groove 72, the lead is equal to the pitch of the particle orienting roller 36'. A single continuous helical land 73 is formed.

Figure 7:
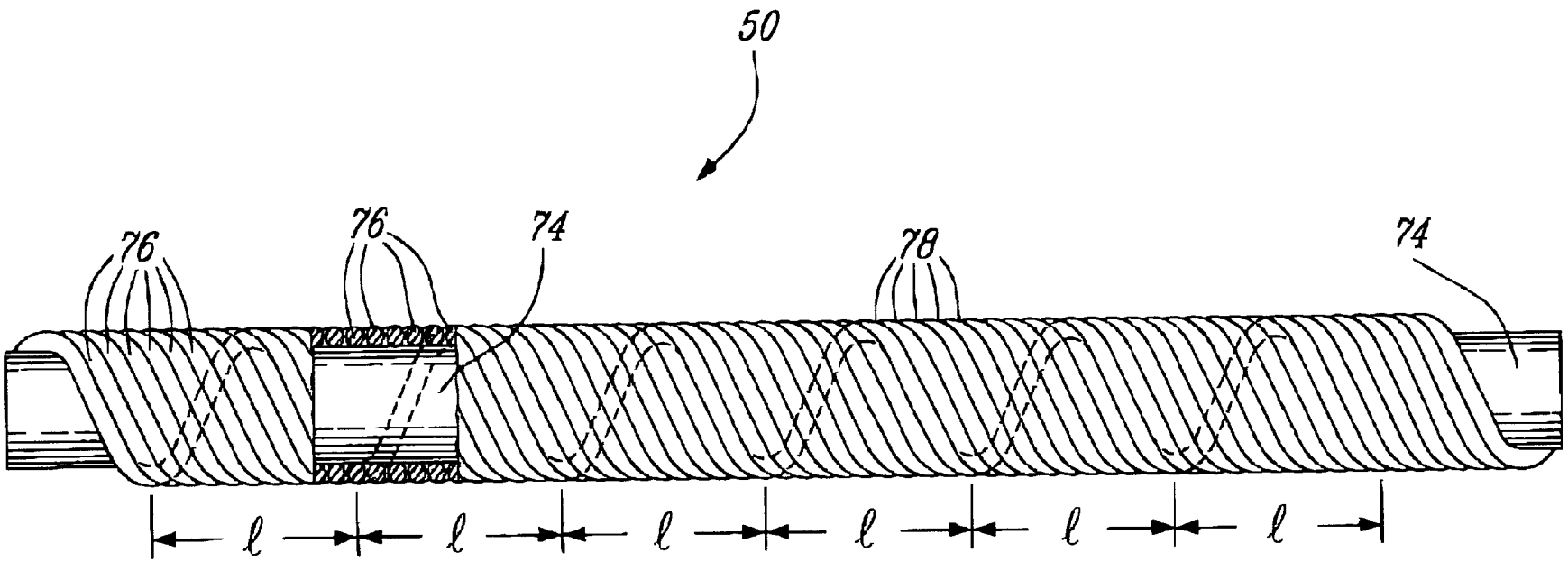
FIG. 7 is a part-sectional side view of a particle orienting roller according to a preferred embodiment of the invention, which is used in the apparatuses shown in FIGS. 1 and 3.

Each of the particle orienting rollers 50A and 50B is a particle orienting roller 50 according to a preferred embodiment of the invention, which is illustrated in FIG. 7. As shown, the roller 50 comprises a cylindrical member 74 and a plurality of juxtaposed continuous helical lands defined by a plurality of juxtaposed wires 76 helically wound about the cylindrical member 74 over a major portion of the length thereof. The wires 76 are wound so as to have the same pitch. A helical particle orienting groove 78 is defined between each pair of adjacent wires 76. The lands defined by the wires 76 together with the grooves 78 define the aforesaid particle orienting pattern 52A,52B. As opposed to the particle orienting rollers 36 and 36' shown in FIGS. 5 and 6, respectively, the lead l of the particle orienting roller 50 is not equal to the pitch thereof, but rather to "n" times the pitch thereof, "n" being the number of wires 76 helically wound about the cylindrical member 74. This enables the particle orienting grooves 78 to orient the polymer particles along a direction which is angled at about 5° to about 85° relative to the travelling direction 40 of the paper web 10, depending on the pitch and the tangential speed of the roller 50.

The pitch of the particle orienting roller 50 has a direct influence on the angle of the particle orienting pattern thereof. Therefore, by changing the pitch of the roller 50, it becomes possible to change the direction of orientation of the polymer particles. Alternatively, this can be done by changing the relative orientation of the roller 50 with respect to the travelling direction 40 of the web 10. Further directional changes can be imparted to the polymer particles by varying the tangential speed of the particle orienting roller 50. The tangential speed can be varied by changing the angular speed of the roller or its diameter. The tangential speed can also be varied by changing the direction of rotation of the roller 50. As previously noted, a change in the direction of rotation of the roller 50 from a counterclockwise to a clockwise rotation may be seen as a change from a positive to a negative tangential speed.

Figure 8:
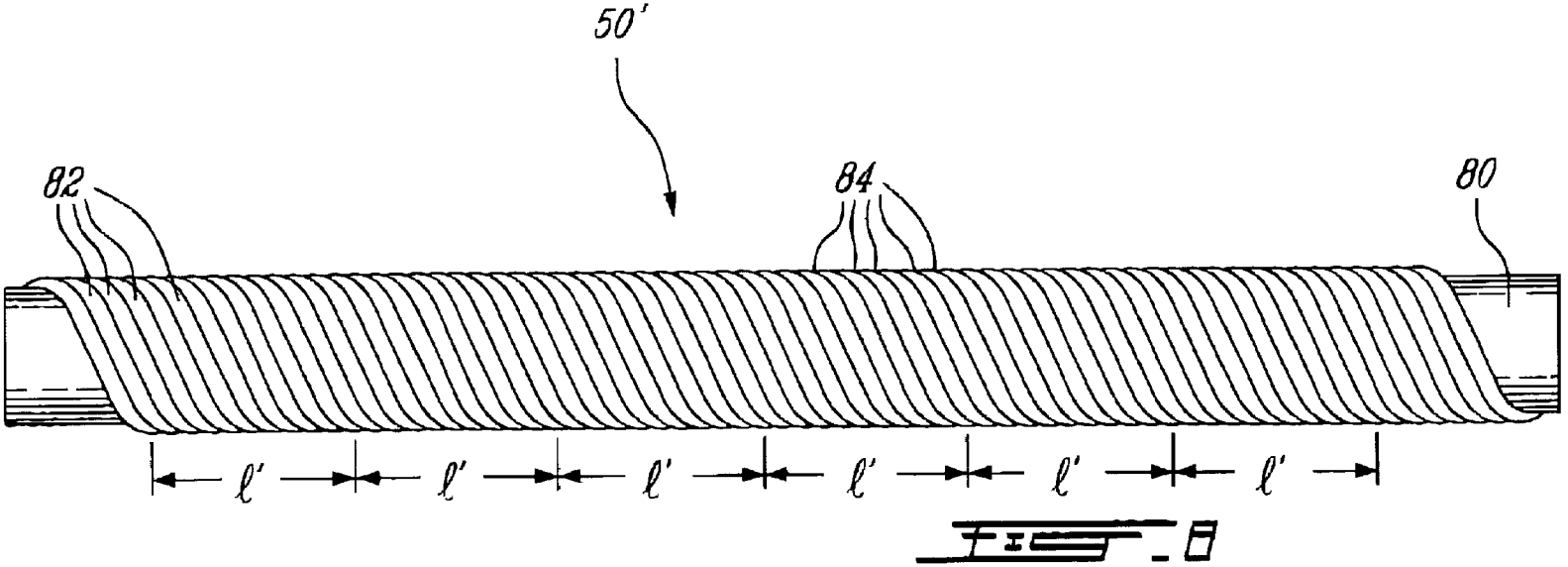
FIG. 8 is a side view of a particle orienting roller according to another preferred embodiment of the invention, which may also be used in the apparatus shown in FIG. 1 or 3.
Figure 9:
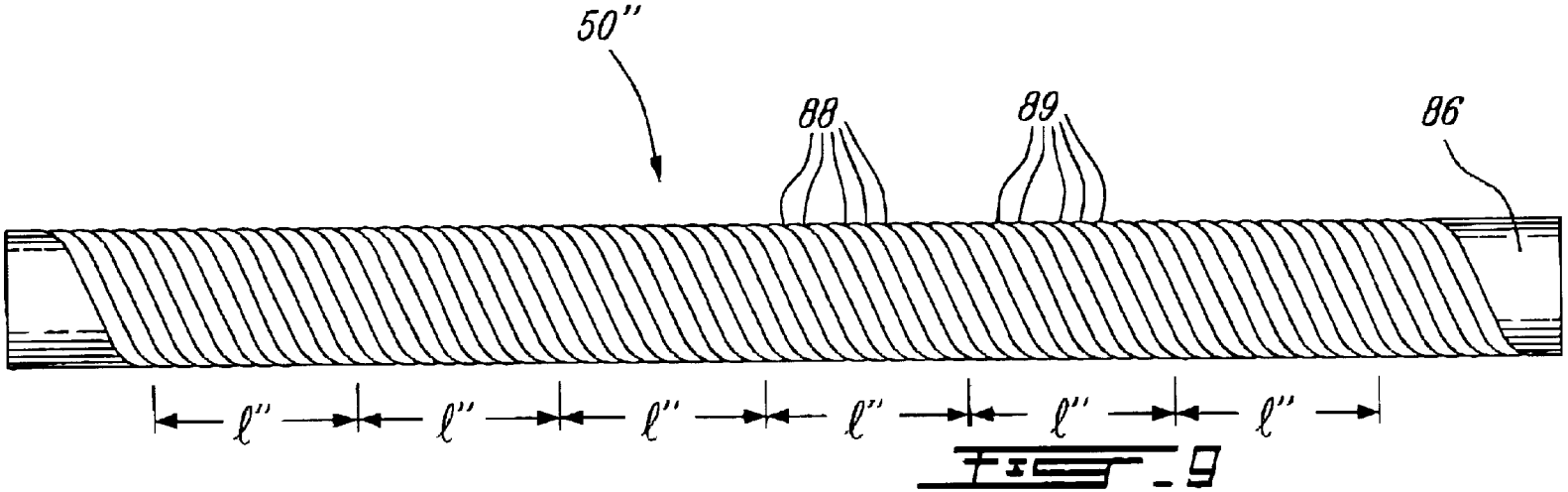
FIG. 9 is a side view of a particle orienting roller according to a further preferred embodiment of the invention, which may also be used in the apparatus shown in FIG. 1 or 3.

Instead of using the particle orienting roller 50, it is also possible to use the rollers 50' and 50" illustrated in FIGS. 8 and 9, respectively. As shown in FIG. 8, the particle orienting roller 50' comprises a cylindrical member 80 and a plurality of juxtaposed continuous helical lands defined by a plurality of helical ribs 82 integrally formed on the peripheral surface of the cylindrical member 80 over a major portion of the length thereof. A helical particle orienting groove 84 is defined between each pair of adjacent ribs 82. The helical grooves 84 are adapted to orient the polymer particles along a direction which is angled at about 5° to about 85° relative to the travelling direction 40 of the paper web 10, depending on the pitch and the tangential speed of the roller 50'. The particle orienting roller 50" illustrated in FIG. 9 comprises a cylindrical member 86 provided with a plurality of helical particle orienting grooves 88 which are integrally defined in the peripheral surface of the cylindrical member 86 and extend along a major portion of the length thereof. The helical grooves 88 are also adapted to orient the polymer particles along a direction which is angled at about 5° to about 85° relative to the travelling direction 40 of the paper web 10, depending on the pitch and the tangential speed of the roller 50". A plurality of juxtaposed continuous helical lands 89 are formed. In the embodiments illustrated in FIGS. 8 and 9, the particle orienting grooves 84 and 88 are similar to the particle orienting grooves 78 of the roller 50 shown in FIG. 7. The lead l' of the roller 50' and the lead l" of the roller 50" are also the same as the lead l of the roller 50.

Figure 10:
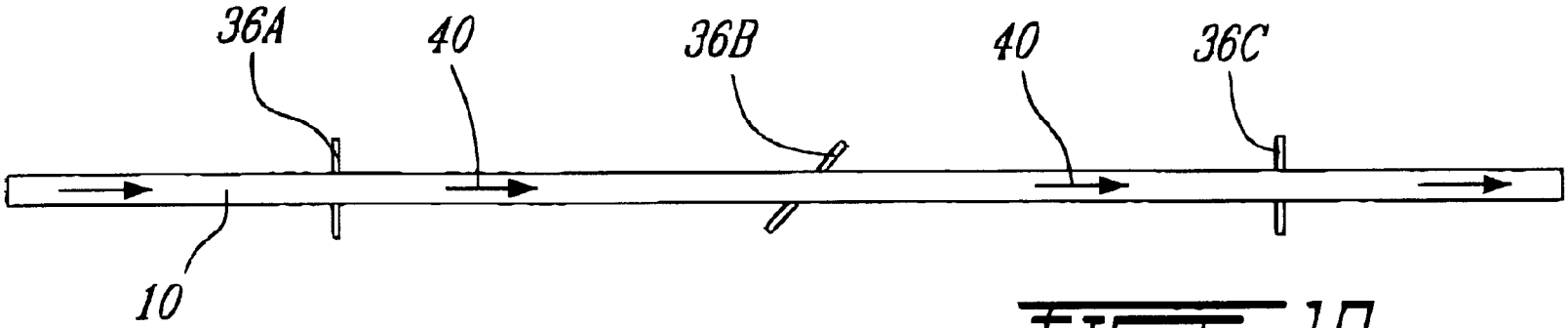
FIG. 10 is a schematic top plan view illustrating how conventional particle orienting rollers may disposed in the travelling path of the substrate to form thereon an oriented three-layer polymeric film, according to a preferred embodiment of the invention.

In the embodiments illustrated in FIGS. 1–4, the rotation axes of the rollers 36, 50A and 50B are all at right angle relative to the travelling direction 40 of the paper web 10. It is possible to achieve the same results without using the particle orienting rollers 50A and 50B, by replacing these rollers with the particle orienting rollers 36 and inclining one of the rollers 36 relative to the travelling direction 40 of the paper web 10. This is schematically illustrated in FIG. 10. As shown, three particle orienting rollers 36A, 36B and 36C are used, the rollers 36A and 36C being disposed so that their rotation axis extends at right angle relative to the travelling direction 40 of the paper web 10. The roller 36B, however, is disposed so that its rotation axis extends at a tilt angle of about 45° relative to the travelling direction 40 of the paper web 10. As a result of such an inclination, the particle orienting groove 68 (shown in FIG. 5) of the roller 36B imparts to the polymer particles an orientation which is angled at about 45° relative to the travelling direction 40 of the paper web 10. Thus, the oriented three-layer film formed as a result of the disposition of the rollers 36A, 36B and 36C comprises a first layer of polymer particles oriented along a direction parallel to the travelling direction 40 of the paper web, a second layer of polymer particles oriented along a direction angled at about 45° relative to the direction 40, and a third layer of polymer particles oriented along a direction parallel to the direction 40. Although the particle orienting roller 36B is shown in FIG. 10 as being inclined at about 45° relative to the travelling direction 40 of the paper web 10, it is possible to dispose the roller 36B so that its rotation axis extends at a tilt angle ranging from about 5° to about 85° relative to the direction 40.

Figure 11:
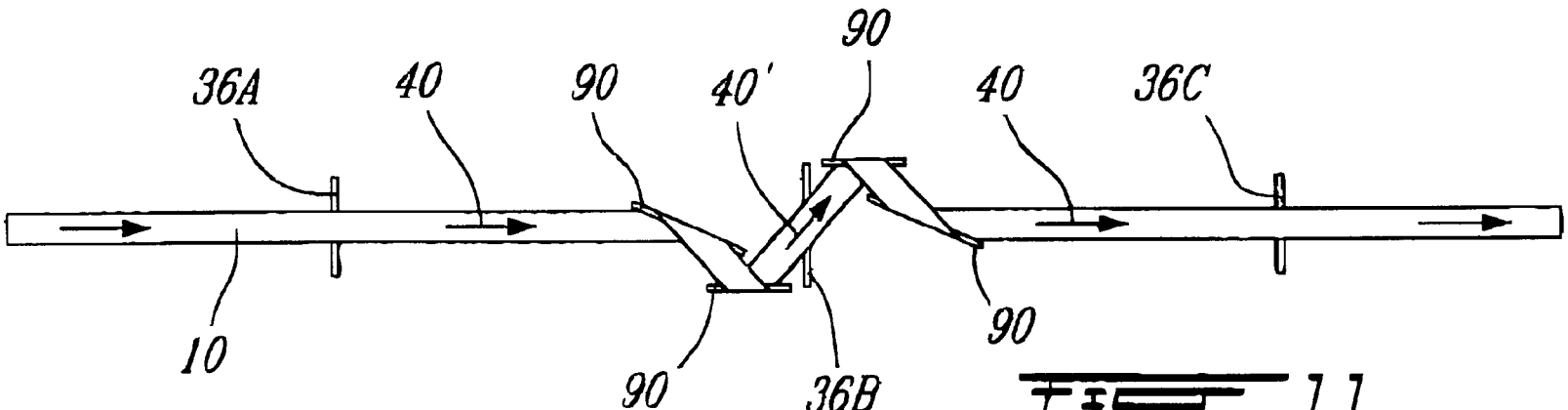
FIG. 11 is a view similar to FIG. 11, illustrating how the travelling direction of the substrate may be varied relative to the rotation axis of one of the conventional particle orienting rollers to form on the substrate an oriented three-layer polymeric film, according to another preferred embodiment of the invention.

The same result as that obtained with the embodiment shown in FIG. 10 can also be achieved by disposing the particle orienting roller 36B so that its rotation axis is parallel to the rotation axis of the particle orienting roller 36A and by varying the travelling direction of the paper web 10, prior to the second coating of polymer dispersion being contacted by the roller 36B, so that it is angled at the aforesaid tilt angle relative to the rotation axis of the roller 36B. This is schematically illustrated in FIG. 11. As shown, by using appropriate guide rollers 90, one may vary the travelling direction of the paper web 10 upstream of the roller 36B so that the travelling direction 40' is angled at about 45° relative to the rotation axis of the roller 36B.

The following non-limiting example further illustrates the invention.

EXAMPLE

An oriented three-layer polymeric film A was formed on a paperboard, by the method described above. The film A comprised a first layer of polymer particles oriented along a direction parallel to the travelling direction of the paperboard (i.e. 0°), a second layer of polymer particles oriented along a direction angled at 45° relative to the travelling direction of the paperboard (i.e. 45°), and a third layer of polymer particles oriented along a direction parallel to the travelling direction of the paperboard (i.e. 0°). The moisture vapor transmission rate (MVTR) of such a film was measured at 37.8° C. and 100% relative humidity and compared with the MVTR of an oriented three-layer polymeric film B formed on the same type of paperboard by replacing the particle orienting rollers 50A and 50B in the apparatus of FIG. 3 with the particle orienting rollers 36 shown in FIG. 5. The film B comprised three layers of polymers particles all oriented along a direction parallel to the travelling direction of the paperboard (i.e. 0°, 0°, 0°). The results are as follows:

| Film A (0°, 45°, 0°) | | Film B (0°, 0°, 0°) | |
|---|---|---|---|
| Film Weight ($g/m^2$) | MVTR ($g/m^2/day$) | Film Weight ($g/m^2$) | MVTR ($g/m^2/day$) |
| 17 | 2 | 17 | 4 |

As it is apparent, the film A has better moisture vapor barrier an the film B.

I claim:

1. A method of forming an oriented multilayer polymeric film on a substrate, comprising the steps of:

a) conveying a substrate along a predetermined path at a predetermined travelling speed and in a predetermined travelling direction;

b) coating the substrate with a polymer dispersion containing polymer particles and a liquid dispersing medium to form on said substrate a first coating of said dispersion;

c) contacting said first coating with a first particle orienting roller driven for rotation about a first longitudinal axis thereof independently of said substrate so as to have a first tangential speed at a surface of the coated substrate, said first particle orienting roller having a first particle orienting pattern arranged at a first angle relative to the travelling direction of said substrate to cause orientation of the polymer particles of said first coating along a first predetermined direction;

d) drying said first coating to cause evaporation of said liquid dispersing medium and formation of a first layer of oriented polymer particles on said substrate; and e) successively forming on said first layer at least one further layer of oriented polymer particles, each further layer being formed by:

i) coating a previously formed underlying layer of oriented polymer particles with said polymer dispersion to form on said underlying layer a further coating of said dispersion;

ii) contacting said further coating with a further particle orienting roller driven for rotation about a further longitudinal axis thereof independently of said substrate so as to have a further tangential speed at the surface of the coated substrate, said further particle orienting roller having a further particle orienting pattern arranged at a further angle relative to the travelling direction of said substrate to cause orientation of the polymer particles of said further coating along a further predetermined direction; and iii) drying said further coating to cause evaporation of said liquid dispersing medium and formation of said further layer of oriented polymer particles on said underlying layer;

wherein at least one said further angle is different from said first angle or at least one said further tangential speed is different from said first tangential speed, thereby forming on said substrate an oriented multilayer polymeric film having at least two layers of polymer particles oriented along two different directions with respect to one another.

2. A method as claimed in claim 1, wherein the longitudinal axis of said first particle orienting roller extends at right angle relative to the travelling direction of said substrate, and wherein said first predetermined direction is parallel to the travelling direction of said substrate.

3. A method as claimed in claim 1, wherein said first particle orienting roller comprises a first cylindrical member rotatable about said first longitudinal axis and a first continuous helical land on said first cylindrical member over at least a portion of the length thereof, said first helical land forming a first continuous helical particle orienting groove along said first cylindrical member, and wherein said first land and said first groove define said first particle orienting pattern.

4. A method as claimed in claim 3, wherein said first helical land is defined by a single wire helically and tightly wound about said portion of said first cylindrical member.

5. A method as claimed in claim 3, wherein said first helical particle orienting groove is integrally defined in a peripheral surface of said first cylindrical member.

6. A method as claimed in claim 3, wherein only one further layer of oriented polymer particles is formed in step (e), said first layer of oriented polymer particles defining said previously formed underlying layer of oriented polymer particles.

7. A method as claimed in claim 6, wherein the longitudinal axis of said further particle orienting roller extends at right angle relative to the travelling direction of said substrate, and wherein said further predetermined direction is angled at about 5° to about 85° relative to the travelling direction of said substrate.

8. A method as claimed in claim 7, wherein said further predetermined direction is angled at about 45° relative to the travelling direction of said substrate.

9. A method as claimed in claim 6, wherein said further particle orienting roller comprises a further cylindrical member rotatable about said further longitudinal axis and a plurality of juxtaposed continuous further helical lands on said further cylindrical member over at least a portion of the length thereof, said further helical lands having a similar pitch and forming a series of further helical particle orienting grooves along said further cylindrical member, and wherein said further lands and said further grooves define said further particle orienting pattern.

10. A method as claimed in claim 9, wherein said further helical lands are defined by a plurality of juxtaposed wires helically wound about said portion of said further cylindrical member, said further helical particle orienting grooves being each defined between adjacent wires.

11. A method as claimed in claim 9, wherein said further helical lands are defined by a plurality of helical ribs integrally formed on a peripheral surface of said further cylindrical member, said further helical particle orienting grooves being each defined between adjacent ribs.

12. A method as claimed in claim 9, wherein said further helical particle orienting grooves are integrally defined in a peripheral surface of said further cylindrical member.

13. A method as claimed in claim 6, wherein the longitudinal axis of said further particle orienting roller and the travelling direction of said substrate are inclined at a tilt angle of about 5° to about 85° relative to one another, and wherein said further predetermined direction is at right angle relative to the longitudinal axis of said further particle orienting roller and is angled at an angle equal to said tilt angle relative to the travelling direction of said substrate.

14. A method as claimed in claim 13, wherein said tilt angle is about 45°.

15. A method as claimed in claim 13, wherein the longitudinal axis of said further particle orienting roller is inclined at said tilt angle relative to the travelling direction of said substrate.

16. A method as claimed in claim 13, wherein the longitudinal axis of said further particle orienting roller is parallel to the longitudinal axis of said first particle orienting roller, and wherein the travelling direction of said substrate is varied prior to said further coating being contacted by said further particle orienting roller so as to be angled at said tilt angle relative to the longitudinal axis of said further particle orienting roller.

17. A method as claimed in claim 13, wherein said further particle orienting roller comprises a further cylindrical member rotatable about said further longitudinal axis and a further continuous helical land on said further cylindrical member over at least a portion of the length thereof, said further helical land forming a further continuous helical particle orienting groove along said further cylindrical member, and wherein said further land and said further groove define said further particle orienting pattern.

18. A method as claimed in claim 17, wherein said further helical land is defined by a single wire helically and tightly wound about said portion of said further cylindrical member.

19. A method as claimed in claim 17, wherein said further helical particle orienting groove is integrally defined in a peripheral surface of said further cylindrical member.

20. A method as claimed in claim 3, wherein two further layers of oriented polymer particles are formed in step (e) by;

i) coating said first layer of oriented polymer particles with said polymer dispersion to form on said first layer a second coating of said dispersion;

ii) contacting said second coating with a second particle orienting roller driven for rotation about a second longitudinal axis thereof independently of said substrate so as to have a second tangential speed at the surface of the coated substrate, said second particle orienting roller having a second particle orienting pattern arranged at a second angle relative to the travelling direction of said substrate to cause orientation of the polymer particles of said second coating along a second predetermined direction;

iii) drying said second coating to cause evaporation of said liquid dispersing medium and formation of a second layer of oriented polymer particles on said first layer;

iv) coating said second layer of oriented polymer particles with said polymer dispersion to form on said second layer a third coating of said dispersion;

v) contacting said third coating with a third particle orienting roller driven for rotation about a third longitudinal axis thereof independently of said substrate so as to have a third tangential speed at the surface of the coated substrate, said third particle orienting roller having a third particle orienting pattern arranged at a third angle relative to the travelling direction of said substrate to cause orientation of the polymer particles of said third coating along a third predetermined direction; and vi) drying said third coating to cause evaporation of said liquid dispersing medium and formation of a third layer of oriented polymer particles on said second layer;

wherein said second angle is different from said first angle or said second tangential speed is different from said first tangential speed, whereby said second predetermined direction is different from said first predetermined direction, and wherein said third angle is different from said second angle or said third tangential speed is different from said second tangential speed, whereby said third predetermined direction is different from said second predetermined direction.

21. A method as claimed in claim 20, wherein the longitudinal axis of said second particle orienting roller extends at right angle relative to the travelling direction of said substrate, and wherein said second predetermined direction is angled at about 5° to about 85° relative to the travelling direction of said substrate.

22. A method as claimed in claim 21, wherein said second predetermined direction is angled at about 45° relative to the travelling direction of said substrate.

23. A method as claimed in claim 21, wherein the longitudinal axis of said third particle orienting roller extends at right angle relative to the travelling direction of said substrate, and wherein said third predetermined direction is angled at about 5° to about 85° relative to the travelling direction of said substrate.

24. A method as claimed in claim 21, wherein the longitudinal axis of said third particle orienting roller extends at right angle relative to the travelling direction of said substrate, and wherein said third predetermined direction is the same as said first predetermined direction.

25. A method as claimed in claim 20, wherein said second particle orienting roller comprises a second cylindrical member rotatable about said second longitudinal axis and a first plurality of juxtaposed continuous helical lands on said second cylindrical member over at least a portion of the length thereof, the helical lands of said first plurality having a similar pitch and forming a first series of helical particle orienting grooves along said second cylindrical member, the lands of said first plurality and the grooves of said first series defining said second particle orienting pattern, and wherein said third particle orienting roller comprises a third cylindrical member rotatable about said third longitudinal axis and a second plurality of juxtaposed continuous helical lands on said third cylindrical member over at least a portion of the length thereof, the helical lands of said second plurality having a similar pitch and forming a second series of helical particle orienting grooves along said third cylindrical member, the lands of said second plurality and the grooves of said second series defining said third particle orienting pattern.

26. A method as claimed in claim 25, wherein the helical lands of said first plurality are defined by a plurality of juxtaposed wires helically wound about said portion of said second cylindrical member, the helical particle orienting grooves of said first series being each defined between adjacent wires.

27. A method as claimed in claim 25, wherein the helical lands of said first plurality are defined by a plurality of helical ribs integrally formed on a peripheral surface of said second cylindrical member, the helical particle orienting grooves of said first series being each defined between adjacent ribs.

28. A method as claimed in claim 25, wherein the helical particle orienting grooves of said first series are integrally defined in a peripheral surface of said second cylindrical member.

29. A method as claimed in claim 25, wherein the helical lands of said second plurality are defined by a plurality of juxtaposed wires helically wound about said portion of said third cylindrical member, the helical particle orienting grooves of said second series being each defined between adjacent wires.

30. A method as claimed in claim 25, wherein the helical lands of said second plurality are defined by a plurality of helical ribs integrally formed on a peripheral surface of said third cylindrical member, the helical particle orienting grooves of said second series being each defined between adjacent ribs.

31. A method as claimed in claim 25, wherein the helical particle orienting grooves of said second series are integrally defined in a peripheral surface of said third cylindrical member.

32. A method as claimed in claim 25, wherein said third particle orienting pattern is the same as said second particle orienting pattern, and wherein said third tangential speed is different from said second tangential speed.

33. A method as claimed in claim 20, wherein said second particle orienting roller comprises a second cylindrical member rotatable about said second longitudinal axis and a plurality of juxtaposed continuous further helical lands on said second cylindrical member over at least a portion of the length thereof, said further helical lands having a similar pitch and forming a series of further helical particle orienting grooves along said second cylindrical member, said further lands and said further grooves defining said second particle orienting pattern, and wherein said third particle orienting roller comprises a third cylindrical member rotatable about said third longitudinal axis and another continuous helical land on said third cylindrical member over at least a portion of the length thereof, said other helical land forming another continuous helical particle orienting groove along said third cylindrical member, and wherein said other land and said other groove define said third particle orienting pattern.

34. A method as claimed in claim 33, wherein said further helical lands are defined by a plurality of juxtaposed wires helically wound about said portion of said second cylindrical member, said further helical particle orienting grooves being each defined between adjacent wires.

35. A method as claimed in claim 33, wherein said further helical lands are defined by a plurality of helical ribs integrally formed on a peripheral surface of said second cylindrical member, said further helical particle orienting grooves being each defined between adjacent ribs.

36. A method as claimed in claim 33, wherein said further helical particle orienting grooves are integrally defined in a peripheral surface of said second cylindrical member.

37. A method as claimed in claim 33, wherein said other helical land is defined by a single wire helically and tightly wound about said portion of said third cylindrical member.

38. A method as claimed in claim 33, wherein said other helical particle orienting groove is integrally defined in a peripheral surface of said third cylindrical member.

39. A method as claimed in claim 33, wherein said third particle orienting pattern is the same as said first particle orienting pattern, and wherein said third tangential speed is the same as said first tangential speed.

40. A method as claimed in claim 20, wherein the longitudinal axis of said second particle orienting roller and the travelling direction of said substrate are inclined at a tilt angle of about 5° to about 85° relative to one another, and wherein said second predetermined direction is at right angle relative to the longitudinal axis of said second particle orienting roller and is angled at an angle equal to said tilt angle relative to the travelling direction of said substrate.

41. A method as claimed in claim 40, wherein said tilt angle is about 45°.

42. A method as claimed in claim 40, wherein the longitudinal axis of said second particle orienting roller is inclined at said tilt angle relative to the travelling direction of said substrate.

43. A method as claimed in claim 40, wherein the longitudinal axis of said second particle orienting roller is parallel to the longitudinal axis of said first particle orienting roller, and wherein the travelling direction of said substrate is varied prior to said second coating being contacted by said second particle orienting roller so as to be angled at said tilt angle relative to the longitudinal axis of said second particle orienting roller.

44. A method as claimed in claim 40, wherein the longitudinal axis of said third particle orienting roller extends at right angle relative to the travelling direction of said substrate, and wherein said third predetermined direction is the same as said first predetermined direction.

45. A method as claimed in claim 40, wherein said second particle orienting roller comprises a second cylindrical member rotatable about said second longitudinal axis and a second continuous helical land on said second cylindrical member over at least a portion of the length thereof, said second helical land forming a second continuous helical particle orienting groove along said second cylindrical member, said second land and said second groove defining said second particle orienting pattern, and wherein said third particle orienting roller comprises a third cylindrical member rotatable about said third longitudinal axis and a third continuous helical land on said third cylindrical member over at least a portion of the length thereof, said third helical land forming a third continuous helical particle orienting groove along said third cylindrical member, said third land and said third groove defining said third particle orienting pattern.

46. A method as claimed in claim 45, wherein said second helical land is defined by a single wire helically and tightly wound about said portion of said second cylindrical member.

47. A method as claimed in claim 45, wherein said second helical particle orienting groove is integrally defined in a peripheral surface of said second cylindrical member.

48. A method as claimed in claim 45, wherein said third helical land is defined by a single wire helically and tightly wound about said portion of said third cylindrical member.

49. A method as claimed in claim 45, wherein said third helical particle orienting groove is integrally defined in a peripheral surface of said third cylindrical member.

50. A method as claimed in claim 45, wherein said second and third particle orienting patterns are the same as said first particle orienting pattern, said first and second tangential speed are the same as said first tangential speed, and wherein said second angle is different from said first angle and said third angle is the same as said first angle.

51. A method as claimed in claim 1, wherein said substrate is in the form of a continuous web.

52. A method as claimed in claim 1, wherein said polymer particles are particles of a waterborne polymer.

53. A method as claimed in claim 52, wherein said waterborne polymer is selected from the group consisting of polyvinylidene chloride, polyvinyl acetate, polyvinyl alcohol and styrene-butadiene copolymers.

54. A method as claimed in claim 52, wherein said liquid dispersing medium comprises water, an alcohol or a mixture thereof.

* * * * *